United States Patent [19]

Enneking

[11] 4,234,133

[45] * Nov. 18, 1980

[54] DEVICE FOR WINDING TEXTILE THREADS

[75] Inventor: Heinrich Enneking, Karlsruhe-Waldstadt, Fed. Rep. of Germany

[73] Assignee: Industrie-Werke Karlsruhe-Augsburg Aktiengesellschaft, Fed. Rep. of Germany

[ * ] Notice: The portion of the term of this patent subsequent to Jun. 18, 1995, has been disclaimed.

[21] Appl. No.: 225,157

[22] Filed: Feb. 10, 1972

Related U.S. Application Data

[63] Continuation-in-part of Ser. No. 852,368, Aug. 22, 1969, abandoned.

[30] Foreign Application Priority Data

Sep. 12, 1968 [DE] Fed. Rep. of Germany ..... 1785336

[51] Int. Cl.[2] ..... B65H 59/38; B65H 54/20

[52] U.S. Cl. ..... 242/45; 242/35.5 R

[58] Field of Search ..... 242/45, 18 DD, 18 A, 242/18 R, 35.5 R, 26

[56] References Cited

U.S. PATENT DOCUMENTS

| | | | |
|---|---|---|---|
| 2,647,697 | 8/1953 | Pollock, Jr. | 242/35.5 R |
| 2,752,105 | 6/1956 | Keith | 242/45 |
| 2,869,796 | 1/1959 | Konig | 242/18 DD X |
| 2,919,865 | 1/1960 | Doherty | 242/35.5 R |
| 3,537,660 | 11/1970 | Schippers et al. | 242/45 |

FOREIGN PATENT DOCUMENTS

| | | | |
|---|---|---|---|
| 289894 | 6/1965 | Netherlands | 242/18 DD |

*Primary Examiner*—Stanley N. Gilreath
*Attorney, Agent, or Firm*—McGlew and Tuttle

[57] ABSTRACT

The device is for winding textile thread, particularly made of synthetic material, into bobbins, and in which a driven drive roll is in frictional engagement with the bobbins wound upon bobbin supports and in which, for the purpose of maintaining a constant winding speed and constant tension in the thread, the latter, before reaching the drive roll, passes over a pivotally mounted compensating roller arranged on a pivotally mounted lever whose pivotal movement is subject to the tension in the thread which passes over the compensating roller. The lever is connected with a potentiometer in the circuit of a control device which adjusts the speed of a motor drivingly connected with said drive roll.

2 Claims, 4 Drawing Figures

DEVICE FOR WINDING TEXTILE THREADS

FIELD AND BACKGROUND OF THE INVENTION

The invention relates to a device for winding textile threads into bobbins with substantially constant winding speed and uniform tensile stress in the material which is being wound and constitutes a continuation-in-part of application Ser. No. 852,368, filed Aug. 22, 1969, now abandoned.

Textile threads, particularly the ones made of synthetic material, constitute a sensitive winding material. It is a requirement that, during the winding of such threads, the winding speed be substantially constant and that also the tensile stress in the thread material be as constant as possible during the entire winding operation. This requirement, however, can be accomplished only incompletely by the known winding devices unless there are employed extremely expensive control devices.

There have already been proposed winding devices in which the bobbins are frictionally driven, while other winding devices have been proposed in which the bobbins are directly driven. In winding devices employing a friction drive, the bobbins, which, have wound upon bobbin supports are their circumferences in a predetermined surface pressure engagement with motor driven drive rolls and, in view of this surface engagement, the drive is performed with a predetermined friction. In the other winding devices in which the bobbins are directly driven, the bobbin carriers are the ones which are positively driven. For this purpose it is necessary to employ adjustable drive motors because, when the bobbin diameters increase, it is necessary to proportionately reduce the speed of the bobbin supports and this is done by reducing the speed of the drive motors.

Winding devices employing a friction drive of the bobbins give the best results as far as the constancy of the thread winding speed and as far as the uniform tension in the thread during the winding operation are concerned, because the synchronous motors used for driving the drive rolls assure a substantially constant circumferential speed of the drive roll. Difficulties arise, however, in maintaining the frictional forces between the surfaces of the bobbins and the surfaces of the drive rolls constant. It happens again and again that, in winding devices of this type in which a great number of winding units are arranged one next to the other, different winding conditions exist on individual winding machines, because it has been proven as impossible to assure that, in all individual winding units, the same slip occurs between the drive rolls and the bobbins driven by the same.

When employing a direct drive in the winding device, it is possible to avoid the difficulties which are encountered during the friction drive of the bobbins, but, nevertheless, it is necessary to employ very expensive adjusting arrangements, while in a frictional drive one drive roll may drive at the same time a number of bobbin supports. In a direct drive each bobbin support has to have an individual motor for driving the bobbin support directly and in addition thereto a special adjusting arrangement has to be provided. Such adjusting arrangements comprise an additional roll which engages the circumference of the gradually growing bobbin and since such an additional roll cannot be finely adjusted, there are still more adjusting elements necessary which respond to the variation in the tension of the thread. These additional means in most instances have the form of a compensating roller.

SUMMARY OF THE INVENTION

The object of the present invention is, therefore, a winding device for textile threads, particularly made of synthetic material, which is simpler in construction than the known devices and still assures that the winding speed is constant and also assures that the tension in the thread during its winding operation remains constant.

In accordance with the invention, a motor driven drive roll is brought into frictional engagement with the circumference of the bobbins to be wound, these bobbins being detachably mounted on bobbin supports. In addition to this basic arrangement there is provided a device for adjusting the speed of the drive roll which operates in accordance with the tension in the thread to be wound. This speed adjusting device, when employing a synchronous motor as a drive for the drive roll, may consist of an adjustable gearing arranged between the motor and the drive roll, or when such an adjustable gearing is not employed, it would be possible to employ in place thereof an adjustable drive motor for the drive roll.

It is, however, in accordance with the invention, an advantage, when, as a value which influences the speed adjusting device, the tension is employed which corresponds to the tension of a single bundle of threads consisting of a number of threads which is wound upon a bobbin support having its circumference engaging a common drive roll, because this, as a rule, will suffice to obtain a suitable adjustment accuracy. For particular purposes the thread in the handle pull produced by a single thread is sufficient when wound upon a bobbin engaging a common drive shaft, whereby the value of one of these threads—for instance, the one having the highest or the thread tension —may be used as an adjustment value.

In another embodiment of the invention, the proposed winding device may have provided in its adjusting circuit a control device which, on one hand, may be used for adjusting the drive roll to a primary speed, and on the other hand, starting with the primary speed, may adjust to a predetermined speed in relation to the tension in the thread. The control device may also be provided with a logical selective unit which, combines the tensile stress in the individual threads, and produces, an adjustment value for the drive roll, which is a function of the stress on the individual threads.

Furthermore, the device of the invention, for the purpose of determining the tension in the thread, may be provided with a conventional compensating roller arrangement in which the compensating roller is arranged in a more or less extensive loop of the thread the size of which loop depends on the thread tension. The movements of the compensating roller during a change in the size of the thread loop are then converted into electric adjustment values. In order to control all winding requirements, it is also possible that, for each bobbin to be wound and which engages a common drive roller, there is provided for each thread a separate compensating roller, whereby the measurement values associated with the individual compensating roller are all introduced into the control device which then selects, for influencing the speed of the drive roll, one of these measurement values—for instance, the one which represents the lowest thread tension.

The advantage of the winding device of the present invention is that its construction is extremely simple and still it is possible to obtain a winding accuracy which heretofore was not obtainable even in connection with complicating adjustment devices.

With these and other objects in view, the invention will now be described with reference to the accompanying drawings which illustrate diagrammatically a few embodiments of the device of the invention.

BRIEF DESCRIPTION OF THE DRAWINGS

Figure 1:
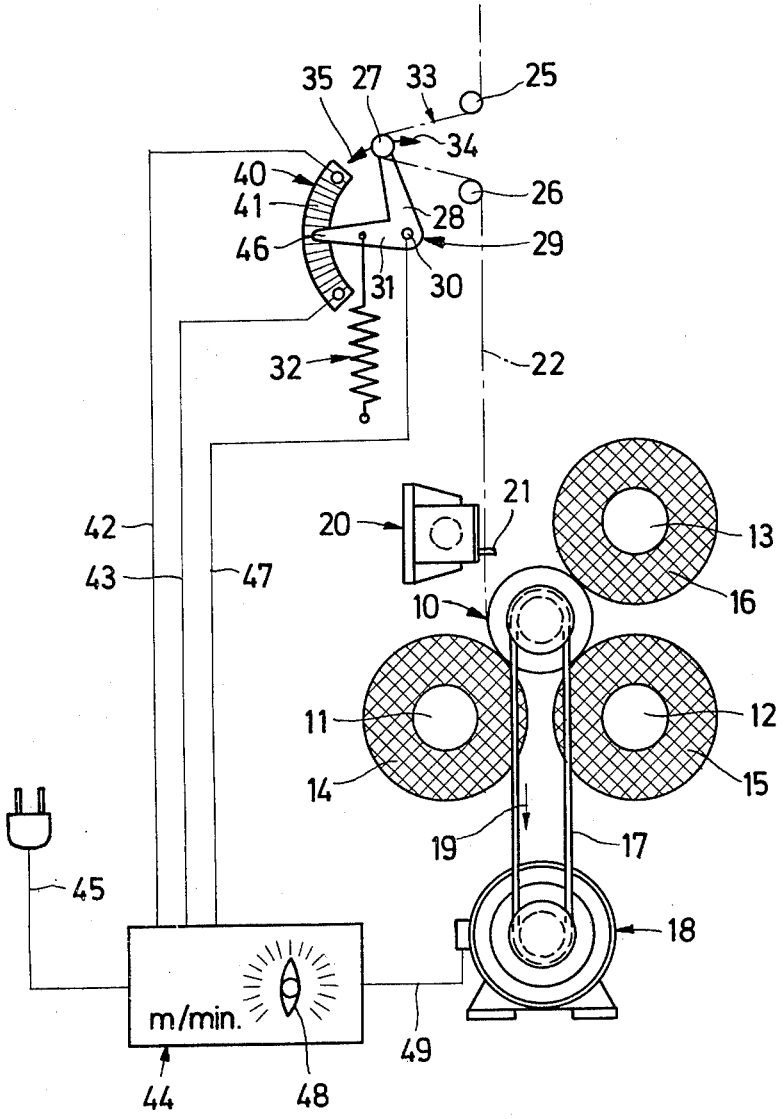
Figure 2:
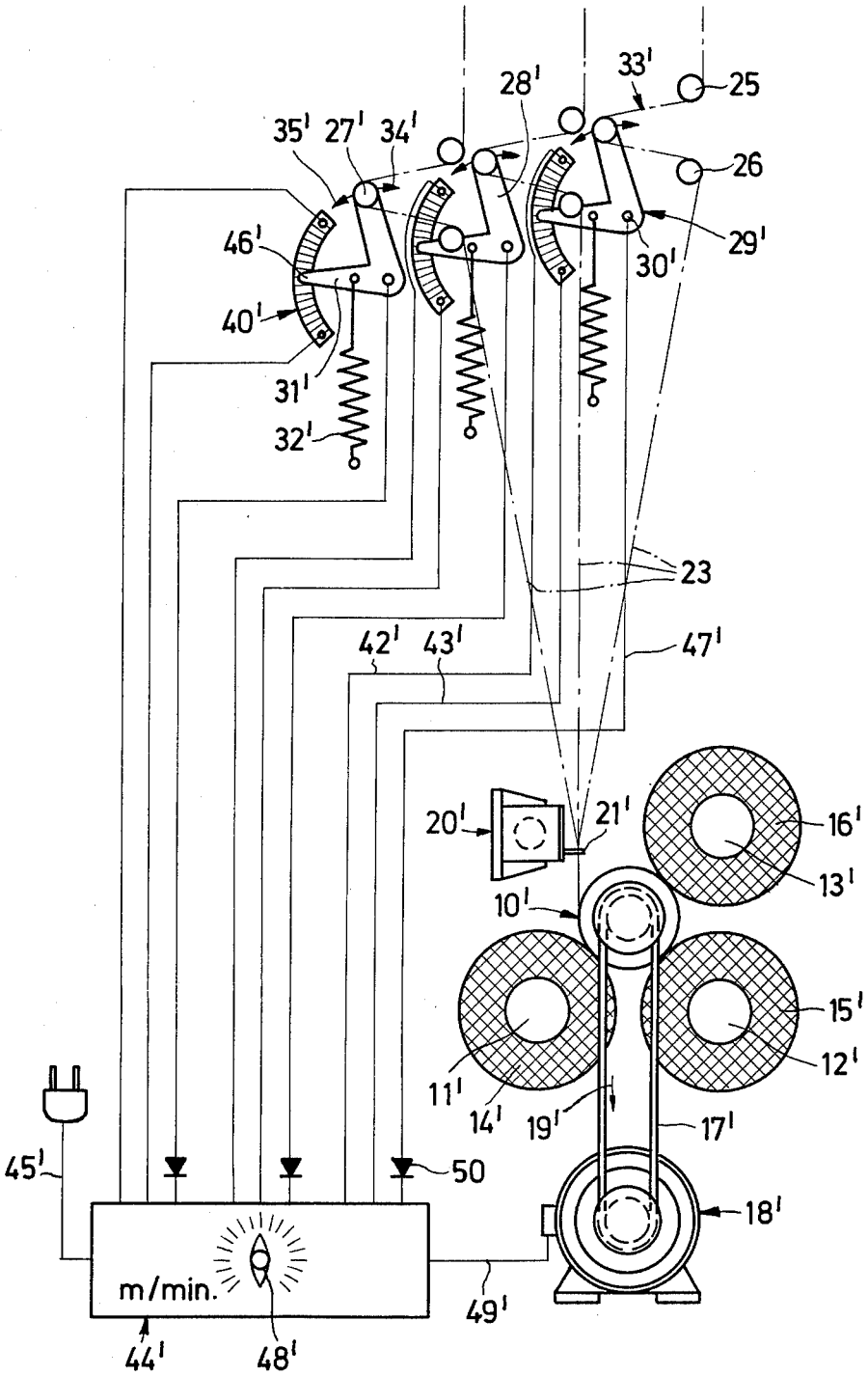

IN THE DRAWINGS:

FIG. 1 illustrates a winding device with a compensating roller arrangement for controlling the thread pull of the thread bundle composed of a number of individual threads, FIG. 2 illustrates a winding device in which a compensating roller arrangement is provided for each individual thread.

Figure 3:
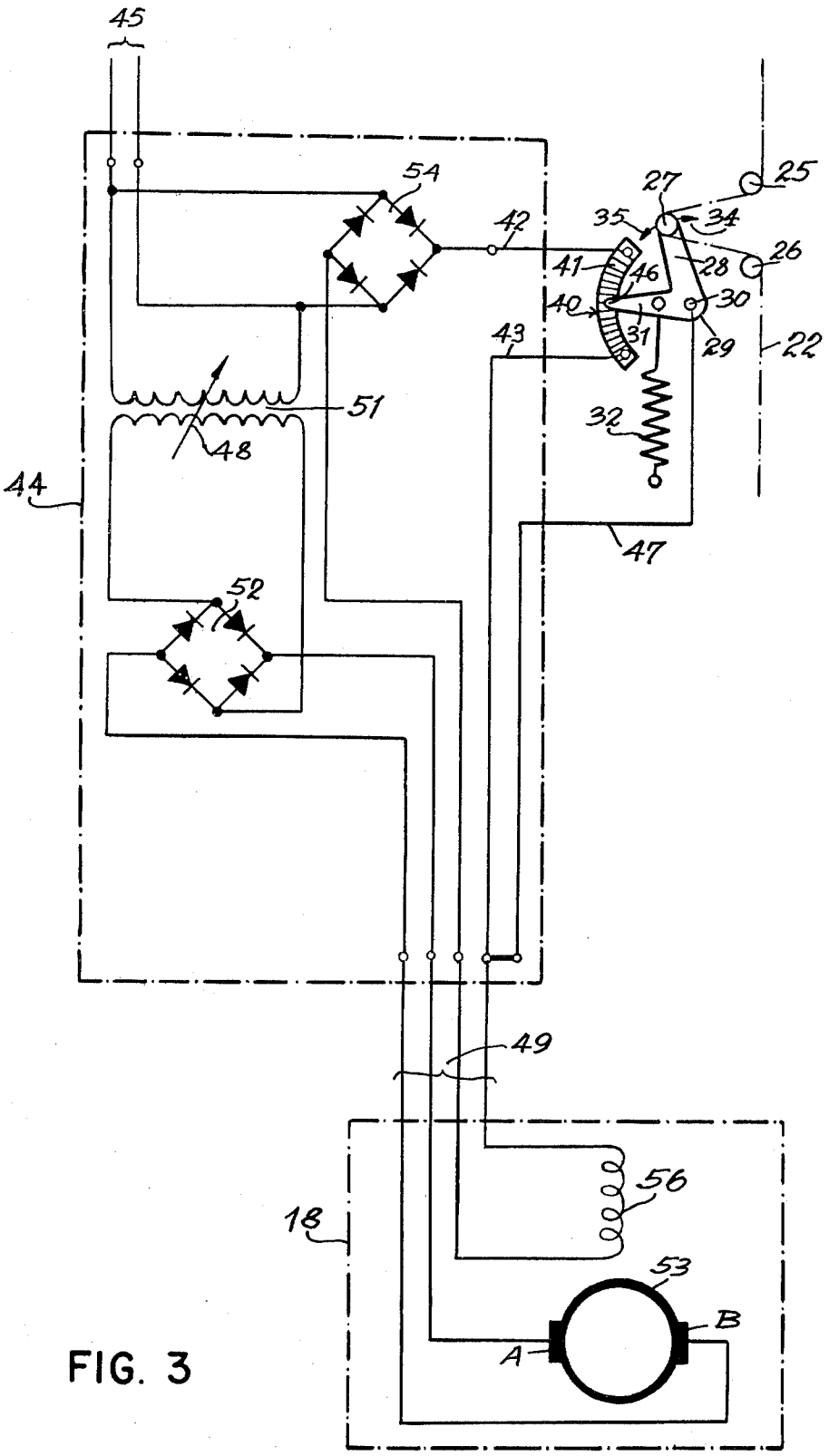
Figure 4:
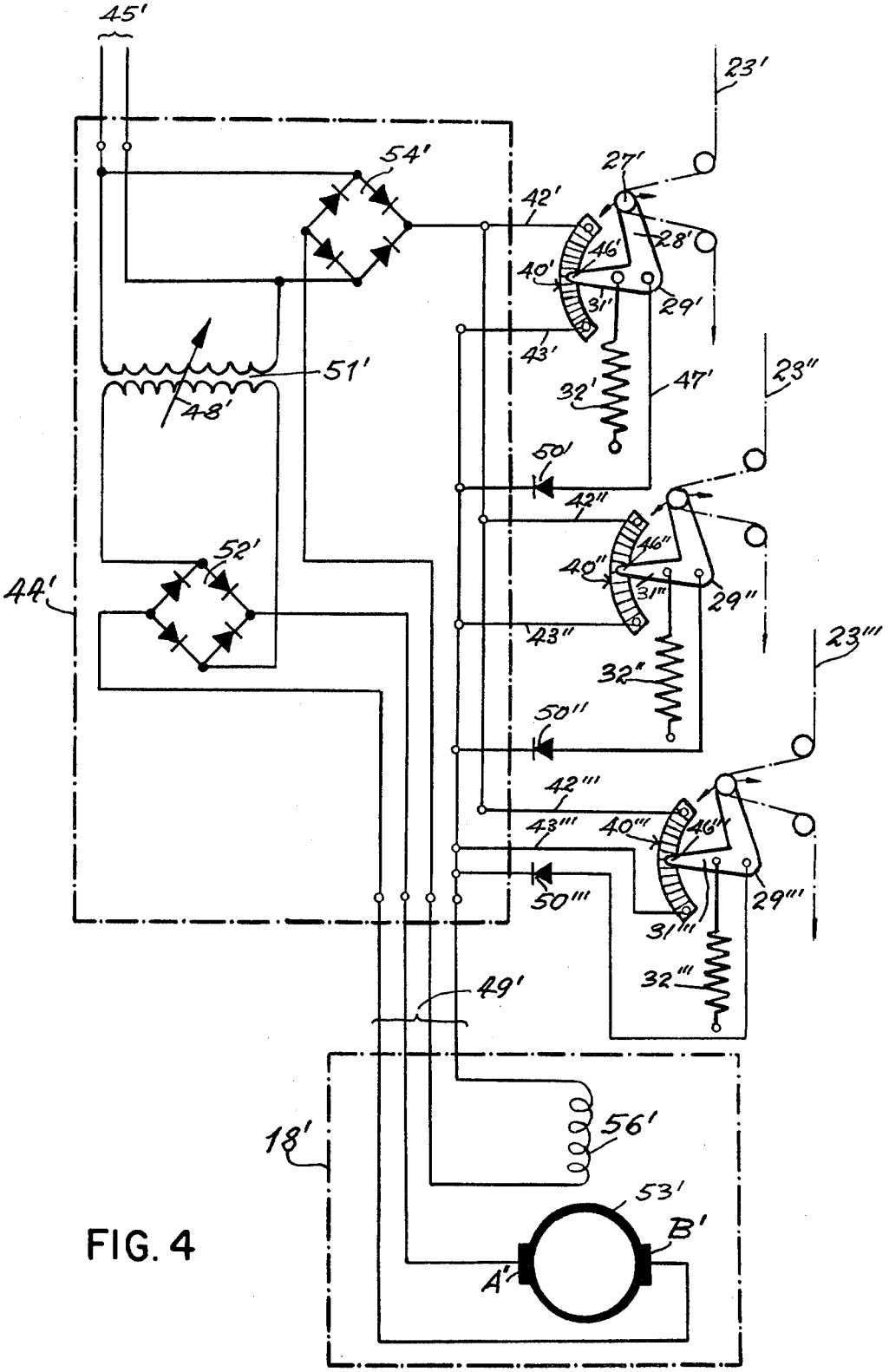

FIG. 3 illustrates a wiring diagram of the speed control means for the drive motor of the winding device shown in FIG. 1, and FIG. 4 illustrates a wiring diagram of the multiple control means for the drive motor of the winding device shown in FIG. 2.

DESCRIPTION OF THE PREFERRED EMBODIMENTS

Referring to FIG. 1, the illustrated winding device is provided with a common horizontally disposed drive roll 10 which is used for simulataneously driving three bobbins 14, 15, and 16 mounted on respective bobbin supports 11, 12 and 13. The drive roll 10 is driven by an electric motor 18 which is connected with the drive roll 10 by an endless belt drive 17. The direction of rotation is indicated by an arrow 19. The feed of the threads—which are to be wound on the bobbin supports to form the bobbins thereon—takes place with the assistance of a traversing device 20 provided with a thread guide 21 which reciprocates in the longitudinal direction of the drive roll 10 and is arranged at a small distance above the surface line of the drive roll 10 which comes into engagement with the thread bundle 22 composed of a number of threads. This surface line of the drive roll is disposed in a horizontal plane passing through the axis of rotation of the drive roll 10. The thread bundle 22 is caused to run up the circumference of the drive roll 10 in counterclockwise direction.

The arrangement of the bobbins and of the traversing device with respect to the drive roll is substantially symmetrical with respect to a horizontal and vertical plane extending through the axis of rotation of the drive shaft of the drive roll 10.

The thread bundle 22 composed of individual threads comes from a not-illustrated melt spinning device—which in arrangements of the type to which the present invention relates—is customarily arranged above the winding device. The guiding of the thread takes place by means of not-illustrated pretreatment stages and rollers. Between the last roller and the traversing device 20 the thread bundle 22 is guided over the compensating roller arrangement. This compensating roller arrangement consists substantially of two vertically spaced thread guide rollers 25 and 26 mounted rotatably on stationary axes and of a compensating roller 27 whose axis of rotation is arranged laterally-spaced from the rollers 25, 26 along a line which extends perpendicularly from the center of an imaginary connecting line between the two stationary rollers 25 and 26. The compensating roller 27 is rotatably mounted on the free end of a leg 28 of a pivotally mounted lever 29 which is constructed as a bell crank lever and is rotatably supported at 30 at its apex. The outer leg 31 of the bell crank lever 29 extends at an angle to the first mentioned leg 28 and is disposed substantially in a horizontal direction. The leg 31 of the bell crank lever 29 has attached thereto one end of a spring 32 the other end of which is attached to a fixed point of the device. This spring 32 is under tension and, when a loop 33 of the threaded bundle 22 is guided over the roller 27 and the two other rollers 25 and 26, produces a predetermined tension in the thread bundle 22. When the tensile stress in the thread bundle 22 increases, then the compensating roller 27 moves opposite of the tension of the spring 32 which is attached to the leg 31, namely, in direction of the arrow 34, but when the tensile stress in the thread bundle 25 decreases, then the compensating roller 27 moves under the action of the spring 32 in the direction of the arrow 35.

It is known that the power of a spring depends upon the length of its extension or stretch. When it is required that the power exerted by the compensating roller 27 on the thread loop 33 must be very stable, then it is, of course, possible to replace the spring which acts on the leg 31 of the bell crank lever 29 by a weight arrangement.

The compensating roller and arm arrangment is associated with a potentiometer 40 in which the movement of the compensating roller, which depends upon the pull exerted on it by the thread, is converted into electrical voltages. This potentiometer is provided with a resistance 41 to the ends of which is applied, by electrical lines 42, 43, a predetermined voltage which, by a control device 44, is supplied to the potentiometer 40. The control device 44 in turn is connected by an electric cable 45 to a not-illustrated source of voltage. A slide contact or top 46 is movable along the resistance 41 and, by means of an electric line 47, is connected to the control device 44. In the diagrammatic illustration of the described embodiment of the invention, the slide contact 46 is attached to the free end of the leg 31 of the bell crank lever 29. Depending upon the position of this slide contact 46 along the resistance 41 there exists between the lines 47 and 42 or 47 and 43 a different voltage, which is used as a control value for the control device 44. The control device 44 is used for adjusting the primary speed of the motor 18, which by means of a belt drive 17 drives the drive roll 10 and this adjustment is effected by a switch 48. The control device 44 is connected with the motor 18, for the purpose of transmitting the control actions, by means of an electric cable 49.

The control device 44 may be of any well known design and arrangement. In the illustrative embodiment shown in FIG. 3 the electric motor 18 is a direct current motor whose speed is controlled on the one hand by the armature 53 with terminals A and B and on the other hand by the magnetic field or exciter winding 56.

In order to impart to the motor 18 a speed which corresponds to the required winding velocity the direct current voltage applied to the armature 53 must be adjustable to be proportional to the required winding velocity. In order to satisfy this requirement the power supply voltage 45 is connected to an adjustable transformer 51 forming a part of the control device 44. The transformer 51 is connected to a rectifier 52 connected to the armature 53 of the motor 18. Through a suitable adjustment of the transformer 51 by means of the switch 48, the desired basic speed of the motor 18 can be achieved.

For driving the motor 18 it is necessary to separately excite the field winding 56. The required exciter voltage for this field winding is also derived from the power supply voltage 45 connected to another rectifier 54 which, as shown in FIG. 3, is connected with the potentiometer 40 and the field winding 56. The speed control of the drive roll 10 in dependence upon the tension in the thread 22, which is caused by the compensating roller 27, is achieved by connecting the potentiometer 40 in series with the rectifier 54 and to the field winding 56. The voltage applied to the field winding 56 is therefore dependent upon the adjustment of the potentiometer 40 or, in other words, upon the position of the bell crank lever 29 which carries on its arm 28 the compensating roller 27.

When the tension in the thread increases the compensating roller 27 moves in the direction of the arrow 34 whereby the effective resistance of the potentiometer 40 is decreased which in turn causes an increase of the exciter voltage at the field winding 56 and thus a decrease of the speed of the motor 18.

In the event there is a slackening of the thread tension the compensating roller 27 moves in the direction of the arrow 35 whereby the effective resistance of the potentiometer 40 is increased which results in a decrease of the voltage applied to the field winding 56 and causing an increase of the speed of the armature 53 of the motor 18.

The control of the armature voltage as described above by the combination of an adjustable transformer 51 and a rectifier 52 is nowadays usually replaced by a silicon control rectifier (SCR).

FIGS. 2 and 4 illustrate an embodiment of the invention in which all parts which are also employed in the embodiment of FIG. 1 are provided with the same basic reference characters, except that the same are provided with accents, (′), (″), (‴). The embodiment of FIGS. 2 and 4 differs, however, from the one illustrated in FIG. 1 in that, for each individual thread 23′, 23″, 23‴ of the thread bundle 23, a separate compensating roller and arm arrangement is employed for engaging the individual threads and being influenced by the tension in the same. Each compensating roller and arm arrangement 27′, 29′; 27″, 29″; 27‴, 29‴ is connected with its own potentiometer 40′, 40″, 40‴, which, in the manner already described in connection with FIG. 1, is connected by electric lines 42′, 42″, 42‴ and 43′, 43″, 43‴ with a common control device 44′ for receiving voltages therefrom. Again, each potentiometer 40′, 40″, 40‴ is provided with a respective slide contact 46′, 46″, 46‴, arranged on the leg 31′, 31″, 31‴ of the associated bell crank lever 29′, 29″, 29‴. The legs 31′, 31″, 31‴ are electrically connected with the common control device 44′. Accordingly, there are provided, in this embodiment of FIGS. 2 and 4, three separate compensating roller and arm arrangments all of which are associated with a single control device 44′. In the electric lines 47′, 47″, 47‴ which connect the respective slide contacts 46′, 46″, 46‴ with the control device 44′ are arranged respective blocking diodes 50′, 50″, 50‴ in such a manner that the electric current can flow only from the slide contacts 46′, 46″, 46‴ toward the control device 44′, but not in a reverse direction.

The wiring diagram of FIG. 4 discloses that the basic speed of the motor 18′ is adjustable as heretofore described in connection with FIGS. 1 and 3, by an adjustable transformer 51′ which is manually adjustable by the switch 48′ and a rectifier 52′ connected with the armature 53′ of the motor 18′, while the excitation of the field winding 56′ of the motor 18′ is automatically controlled by the rectifier 54′ and the three potentiometers 40′, 40″, 40‴, connected with the field winding 56′ as shown, so as to change the excitation of the latter whenever the tension in any one of the three threads 23 changes.

What I claim is:

1. In a device for winding synthetic resin textile threads on bobbins at a substantially constant winding speed, of the type including a compensating roller engageable with a thread loop and mounted on a movable arm for fine regulation of the thread tension, a drive roller driven by an electric motor, and bobbins interchangeably mounted on bobbin supports and pressed with a predetermined force into frictional engagement with the periphery of the drive roller for rotation thereby to wind a thread thereon, the improvement comprising, in combination, a control device connected to a source of electric potential and to said electric motor and including a motor speed adjusting element controlled by said arm for movement in accordance with variations in thread tension, as determined by variations in said thread loop engaged by said compensating roller, to control continuously the speed of said electric motor to control continuously the peripheral speed of said drive roller to maintain the thread tension constant, said motor speed adjustment element comprising, a potentiometer connected to said device to have a potential from said source impressed thereacross; and an adjustable tap forming part of said potentiometer and connected to said device; said adjustable tap being mounted on said arm for adjustment of said potentiometer, there being plural synthetic resin textile threads each wound on a respective bobbin; each textile thread having the respective thread loop engaged by a respective compensating roller mounted on a respective movable arm; a respective potentiometer associated with each movable arm and including a sliding contact carried by the assoicated movable arm; said control device controlling the speed of said electric motor as a function of the displacements of said movable arms.

2. In a device for winding synthetic resin textile threads on bobbins, the improvement claimed in claim 1, in which said speed control device is an electronic speed regulating means; a speed selector switch included in said electronic speed regulating means and operable to preselect the speed of said electric motor; said potentiometers being connected to parallel to said electronic speed regulating means and said sliding contacts being connected in parallel to said electronic speed regulating means; said electronic speed regulating means controlling the speed of said electric motor in accordance with the particular thread tension representing the largest deviation from said preselected speed of said motor.

* * * * *